US005771485A

United States Patent [19]

Echigo

[11] Patent Number: 5,771,485

[45] Date of Patent: Jun. 23, 1998

[54] APPARATUS AND METHOD FOR DETECTING A VELOCITY OF A MOVING OBJECT

[75] Inventor: Tomio Echigo, Kanagawa-ken, Japan

[73] Assignee: International Business Machines Corporation, Armonk, N.Y.

[21] Appl. No.: 632,539

[22] Filed: Apr. 19, 1996

[30] Foreign Application Priority Data

Apr. 19, 1995 [JP] Japan ..... 7-093833

[51] Int. Cl.[6] ..... G08G 1/017; G08G 1/054

[52] U.S. Cl. ..... 701/119; 701/28; 701/117; 382/107; 382/122; 340/936; 340/937

[58] Field of Search ..... 364/436, 437, 364/438, 424.033, 426.01, 426.044, 460, 565; 340/937, 917, 933, 936, 942; 250/559.04, 559.05, 559.29; 348/148, 143, 147, 149; 382/154, 104, 107, 122

[56] References Cited

U.S. PATENT DOCUMENTS

| | | | |
|---|---|---|---|
| 4,433,325 | 2/1984 | Tanaka et al. | 340/937 |
| 4,709,264 | 11/1987 | Tamura et al. | 358/479 |
| 4,825,393 | 4/1989 | Nishiya | 364/560 |
| 4,847,772 | 7/1989 | Michalopoulos et al. | 364/436 |
| 5,353,021 | 10/1994 | Toyama | 340/937 |
| 5,509,082 | 4/1996 | Toyama et al. | 382/104 |

*Primary Examiner*—Tan Q. Nguyen
*Attorney, Agent, or Firm*—Ronald L. Drumheller

[57] ABSTRACT

An apparatus for detecting a velocity of a moving object includes: a camera for photographing a predetermined area in which the object moves, at intervals of time T; a projector for projecting brightness information of each pixel in an image photographed at the intervals of time T by the camera, onto a longitudinal axis along a moving direction of the object, and for accumulating each brightness value on the longitudinal axis to generate pieces of one-dimensional projected information; a buffer for storing the pieces of one-dimensional projected information from the camera; and a detector for determining the velocity of the object moving in the predetermined area from the pieces of one-dimensional projected information stored in the buffer. Information to be processed becomes one-dimensional projected information, so even if there are a large number of pieces of one-dimensional projected information, they will be nearly the same as an amount of information of an image photographed at intervals of time T. Accordingly, information can be processed simply and a velocity can be detected accurately.

6 Claims, 4 Drawing Sheets

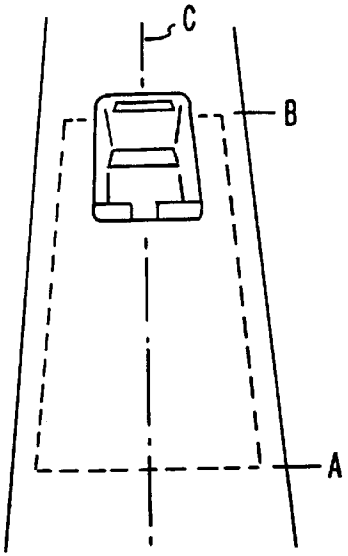
FIG. 2
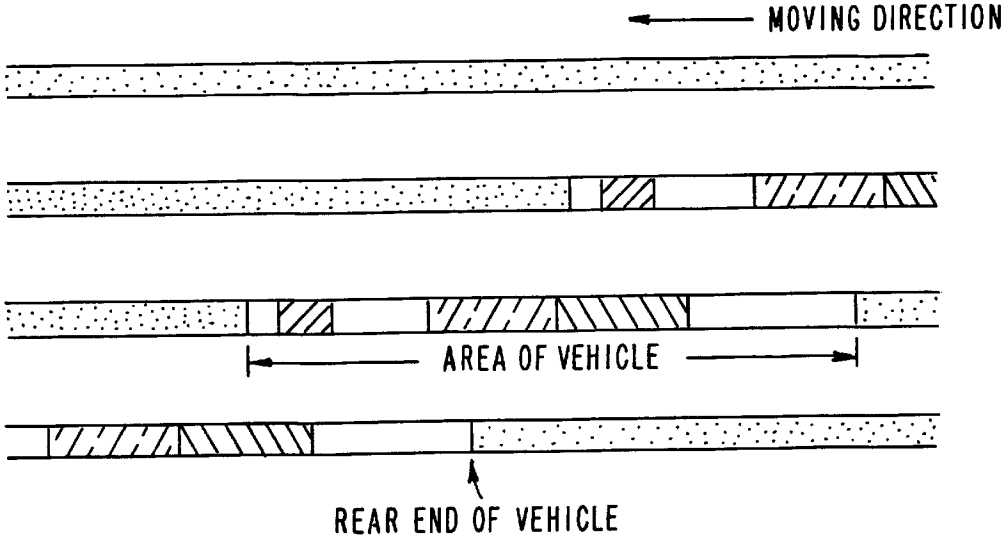
FIG. 3A
FIG. 3B
FIG. 3C
FIG. 3D

APPARATUS AND METHOD FOR DETECTING A VELOCITY OF A MOVING OBJECT

BACKGROUND OF THE INVENTION

1. Field of the Invention

The present invention relates to an apparatus and method for detecting the movement of a vehicle, i.e., the state of traffic, and more particularly, to an apparatus and method for detecting the velocity of a moving object.

2. Related Art

There are a wide variety of detection techniques of vehicle velocity for measuring the amount of traffic. For example, the photographing area of a camera is set perpendicular to the moving direction of a vehicle, and a slit is provided at a specified position of the photographing area. And, only an image of a vehicle passing through this slit is accumulated, and each area of the vehicle is cut out and from the length of the vehicle is converted into a velocity. In this method, the velocity of a vehicle cannot be detected unless the length of the vehicle is known in advance, and also vehicles must be accurately cut out one by one (see J. Y. Zhen and S. Tsuji, "From Anorthoscope Perception to Dynamic Vision," IEEE Int'l Conf. R & A, vol. 2, pp. 1154–1160, 1990).

Also, in another method, two slits are set with a predetermined distance, images passing through the two slits are related by dynamic programming so that the moving time of a vehicle moving between slits is measured, and the moving velocity is calculated from the space between the slits.

Since this method has a fixed distance to be measured, it takes a long time to obtain velocity information in the case of a slow speed vehicle and at the time of a traffic snarl, and only inaccurate information is obtained.

In still another method, a moving component is obtained from the histogram of the edge of a vehicle in one frame. However, in a case where a vehicle moves at high speed, the vehicle edge becomes vague within one frame, so the vehicle edge cannot be determined with the histogram (see Segawa, Shiobara, and Sasaki, "Real Time Measurement of Traffic Flow by Animation Processing System ISHHTAR," Special Interest Group on Computer Vision, Information Processing Society of Japan, 91–7, pp. 47–54, 1994).

Also, PUPA 6-217311 discloses an apparatus where the information of a moving body and the information of predetermined immobile facilities are extracted from an image photographed by a camera and the velocity of the moving body is detected from the information of the lengths of the facilities in the background. However, since a two-dimensional image photographed is processed, if the number of pixels are increased, the velocity detecting process will take a long time and the pixels of an unnecessary portion will need to be processed.

Also, PUPA 6-180749 discloses an apparatus where with previously photographed background images, a difference of the background and a continuous difference of a moving object are detected, and based on these, the moving object and a stationary object can be detected. An apparatus such as this is effective when the moving direction of a moving object is not constant, or in measurements in a place where it is supposed that a moving object and a stationary object exist together. However, in a place where the moving directions of objects are constant and the moving states of the objects as a whole are substantially the same, processing becomes complicated, so the above-described apparatus is not suitable for high-speed processing.

SUMMARY OF THE INVENTION

It is accordingly an object of the present invention to provide an apparatus and method for simply detecting a moving velocity of an object (for example, vehicle).

Also, another object of the present invention is to improve the speed of processing by reducing the number of pixels generated for velocity detection processing during a sampling time T, without processing as two-dimensional information of an image from photographing means.

Further, still another object of the present invention is to reduce the influence of background states and detect an accurate velocity.

A further object of the present invention is to make appropriate adjustment of signal timing for regulating an amount of traffic and a velocity possible by providing an apparatus and method for achieving the above-described objects.

To achieve the above objects, there is provided according to the present invention an apparatus for detecting a velocity of a moving object, which comprises photographing means for photographing a predetermined area in which the object moves, at intervals of time T; projecting means for projecting brightness information of each pixel in an image photographed at the intervals of time T by the photographing means, onto an axis along a moving direction of the object, and for accumulating each brightness value on the axis to generate one-dimensional projected information; storage means for storing the one-dimensional projected information from the projecting means; and detecting means for detecting the velocity of the object moving in the predetermined area with a plurality of pieces of the one-dimensional projected information stored in the storage means. With this, information to be processed becomes one-dimensional projected information, so even if there are a large number of pieces of one-dimensional projected information, they will be nearly the same as an amount of information of an image photographed at intervals of time T. Accordingly, information can be processed simply and a velocity can be detected accurately.

Also, the detecting means may include means for spatially differentiating the pieces of one-dimensional information which are continuous as one image.

Further, the apparatus of the present invention may further comprise movement detecting means for detecting that an object moving in the predetermined area exists, and the detecting means is operated when a movement of the object is detected by the movement detecting means.

The photographing means photographs an image in a predetermined area in which the object moves at intervals of time T. The projecting means projects brightness information of each pixel in the image photographed at the intervals of time T on an axis along a moving direction of the object, and the projected brightness value is accumulated on the axis to generate one-dimensional projected information. Further, the one-dimensional projected information from the projecting means are stored in the storage means, and the velocity of the object moving in the predetermined area is detected with the pieces of one-dimensional projected information stored in the storage means. When the velocity of the object is detected, continuous pieces of one-dimensional information are spatially differentiated as one image.

Also, if the detecting operation is executed only when a movement of the object in a predetermined area is detected, an amount of processing will be able to be reduced.

BRIEF DESCRIPTION OF THE DRAWINGS

FIG. 2 illustrates an example of an image photographed with a camera;

FIGS. 3A–3D illustrates an example of one-dimensional projected information;

DESCRIPTION OF PREFERRED EMBODIMENTS

Figure 1A:
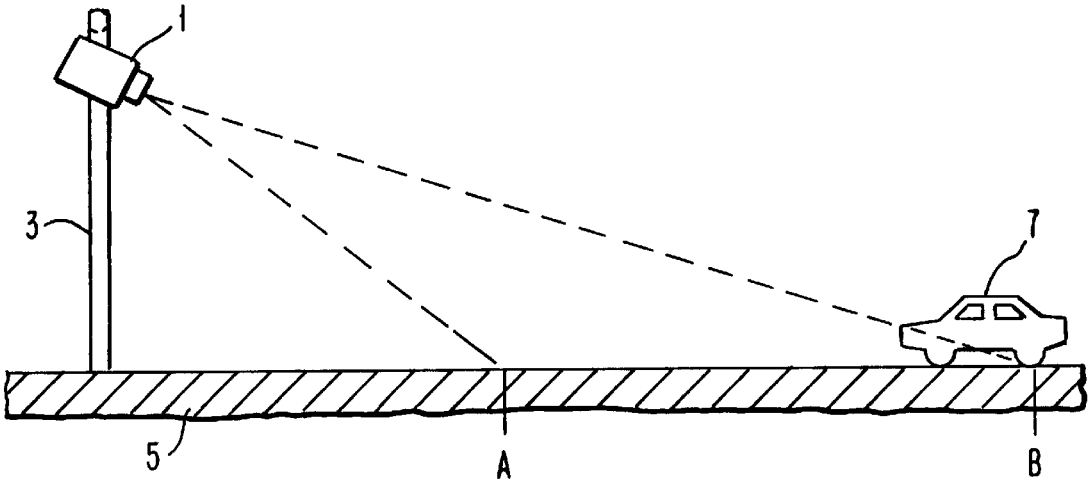
FIG. 1A is a side view used to explain the present invention.
Figure 1B:
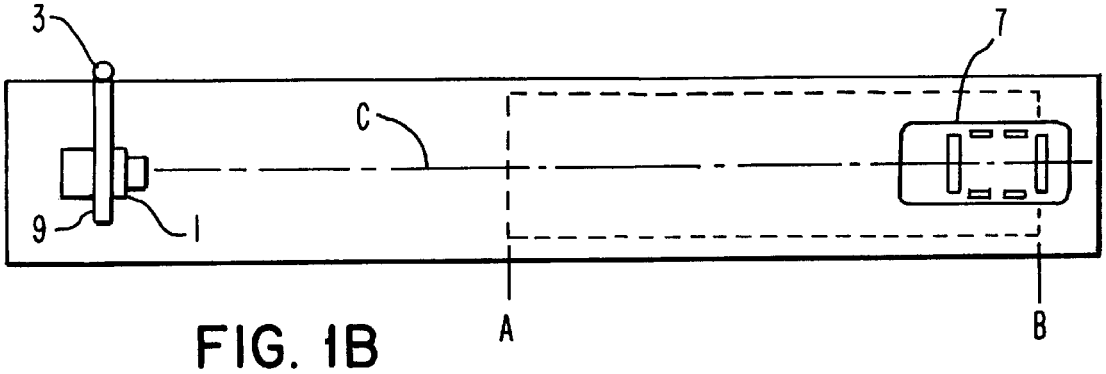
FIG. 1B is a top plan view used to explain the present invention.

First, a description will be made of how a moving object (in this embodiment, vehicle) is photographed with a photographing device (camera). Referring to FIG. 1A, a camera 1 is supported by a post 3 standing on a road 5. A vehicle 7 is traveling on the road 5. In FIG. 1A the photographing range (area) of the camera 1 is an area between A position and B position. Therefore, a portion of the vehicle 7 has entered the photographing area. In FIG. 1B which is a top plan view of FIG. 1A, a support bar 9 is provided in the post 3 in parallel to the road 5 and supports the camera 1 which photographs an area enclosed by broken lines. The image photographed by the camera 1 will become as shown in FIG. 2 (inside broken lines).

Next, a description will be made of how the image thus photographed is processed. If the camera 1 is set at the position shown in FIGS. 1A and 1B, the background image of the vehicle 7 will be the road 5, but the surface state of the road 5 will change with time. In other words, an image to be processed is photographed under various natural environments, such as day and night, fine weather, rainy weather, and cloudy weather, so the image needs to be stable in every state. Further, in a case where a vehicle moving at high speed is photographed, the movement appears over a plurality of pixels in one frame of an image, and the background and the edge of the vehicle become vague. To cope with this vagueness, the shutter speed of the camera can be accelerated, but on the other hand, the time of accumulating light signals in a photographing element becomes short, so the signal-to-noise ratio is deteriorated. Since light becomes weak particularly at dusk or in rainy weather, and also from the standpoint of the above-described stability, a method such as this cannot be adopted.

Also, in a case where a two-dimensional image photographed is used like background art and differential processing must be performed to a vague image such as described above, a differentiated value is expanded to the moving direction component of a vehicle. Since the differential operation is weak to noise, an error will be easily caused to occur if a distance traveled by the vehicle is obtained from the differentiated value in correspondence with the frame. A method using only brightness information on an image photographed is conceivable, but only headlights can be photographed at night, so an additional process of reliably catching the headlights becomes necessary at night. Also, in a case where two-dimensional information is used, there is the drawback that correlation calculation takes a long time.

Further, in a straight road such as the one shown in FIGS. 1A, 1B and 2, the vehicle 7 travels straight. Also, if the photographing area is made short (for example, length sufficient for one vehicle (about 5 m)), the road in that portion can be considered straight. Further, a road, where an amount of traffic must be measured, is usually expected to have a large amount of traffic and a small number of sharply curved portions. Also, if performing adjustment of signal timing is considered, what is photographed will be the vicinity of an intersecting point, and even in a case where there are a plurality of lanes, there are a small number of lane changes. Therefore, an amount of traffic and the velocity of the vehicle will be able to be sufficiently measured if the movement (advance) of the vehicle 7 is considered straight and there is information along the longitudinal center line C of a lane which becomes the longitudinal axis of the moving direction.

Therefore, in the present invention, the brightness information of an image photographed is projected on the longitudinal center line C of a lane, and the sum of pieces of information is obtained and converted into one-dimensional information. The advantages of such processing are obtained as follows.

(1) An additional process of searching headlights even at night is not needed while holding edge information on the head of a vehicle.

(2) Uniform noise, which appears on an image, is reduced by taking the sum of pieces of brightness information. In addition, the differentiation of one-dimensional information becomes stable.

(3) Since the search between images photographed is in one-dimensional information, it is simple and a great deal of processing is reduced.

An example of this one-dimensional information is shown in FIGS. 3A–3D. FIG. 3A shows the state where the vehicle has not moved into the photographing area, and FIG. 3B shows the state where the head of the vehicle has moved into the photographing area. FIG. 3C shows the state where the entire vehicle has moved into the photographing area, and FIG. 3D shows the state where the head of the vehicle has moved out of the photographing area. Thus, a reduction in the number of pieces of comparison information reduces the load of correlation calculation.

Figure 4:
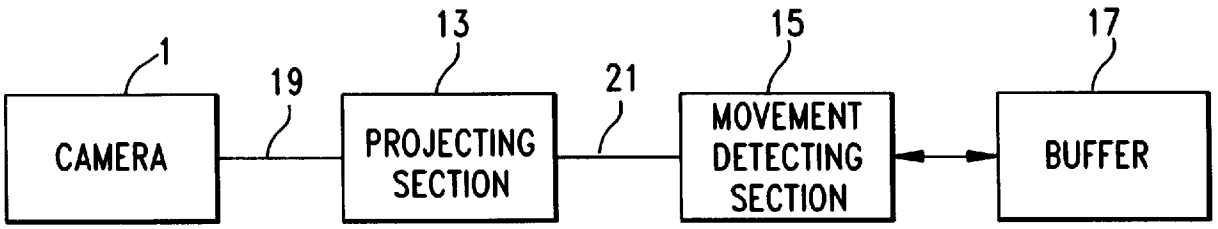
FIG. 4 is a block diagram showing an apparatus of the present invention.

Before describing a velocity detecting process using one-dimensional projected information obtained in this way, an apparatus for carrying out the entire process will be described with FIG. 4. This apparatus is constituted by a camera 1, a projecting section 13, a movement detecting section 15, and a buffer 17, and they are connected in the recited order through buses 19, 21, and 23. The set positions of the constitutional elements are different depending upon how an image photographed or a velocity detected is used, except that the camera 1 must be set on a road. For example, in order to provide a camera above signal lights and change the timing of the signal lights, it is preferable that all constitutional elements are set in the neighborhood of the signal post. However, in a case where monitoring must be performed by a machine or person in a remote place, a velocity may be detected at a set position to transmit only information on the velocity, or if an image photographed is also needed, the projecting section 13 and the sections thereafter may be set in a remote place by extending the bus 19. In a case where an image photographed is needed, it is conceivable to provide an image compression device before sending to the bus 19 and send the image after it is compressed.

The operation of the apparatus of FIG. 4 will be described. The camera 1 photographs an image of a predetermined area such as described above, at intervals of time T. This time T is obtained by determining a distance between the A and B positions in FIGS. 1A and 1B (since two images to be photographed must be compared, in fact ½ of this distance is used) and determining the detectable maximum velocity of a vehicle which travels. For example, assuming that the length between A position and B position is 5 m and the detectable maximum velocity is 200 km/h, there will be the need to photograph an image at intervals of a time shorter than T=0.045 sec. However, actual photographing by a camera depends upon the field frequency of the camera (usually 17 msec). In other words, only the time T, which is an integer times this field frequency, can be used. Although in the following description there are some cases where a numerical value is used independently of this field frequency of a camera, it is preferable in such cases that an appropriate time T corresponding to the camera field frequency is employed. An image photographed is sent to the projecting section 13 through the bus 19. The projecting section 13 projects the brightness information on each pixel onto a longitudinal axis along the moving direction of a predetermined moving object (vehicle) and accumulates. And, the pieces of information accumulated are stored in the movement detecting section 15 through the bus 21, as one-dimensional projected information of the number of pixels corresponding to the above-described length of A and B. The operation of this movement detecting section 15 will be described later.

The buffer 17 has a predetermined number, k, of storage positions, and it is preferable that it comprises a ring buffer having k storage positions. Assuming that the storage positions are numbered 0 to k−1, then the buffer 17 operates so that the latest one-dimensional projected information is input to the 0 storage position and the information stored in the 0 storage position is stored in the first storage position. The information stored in the last (k−1)th storage position is discarded.

Figure 5:
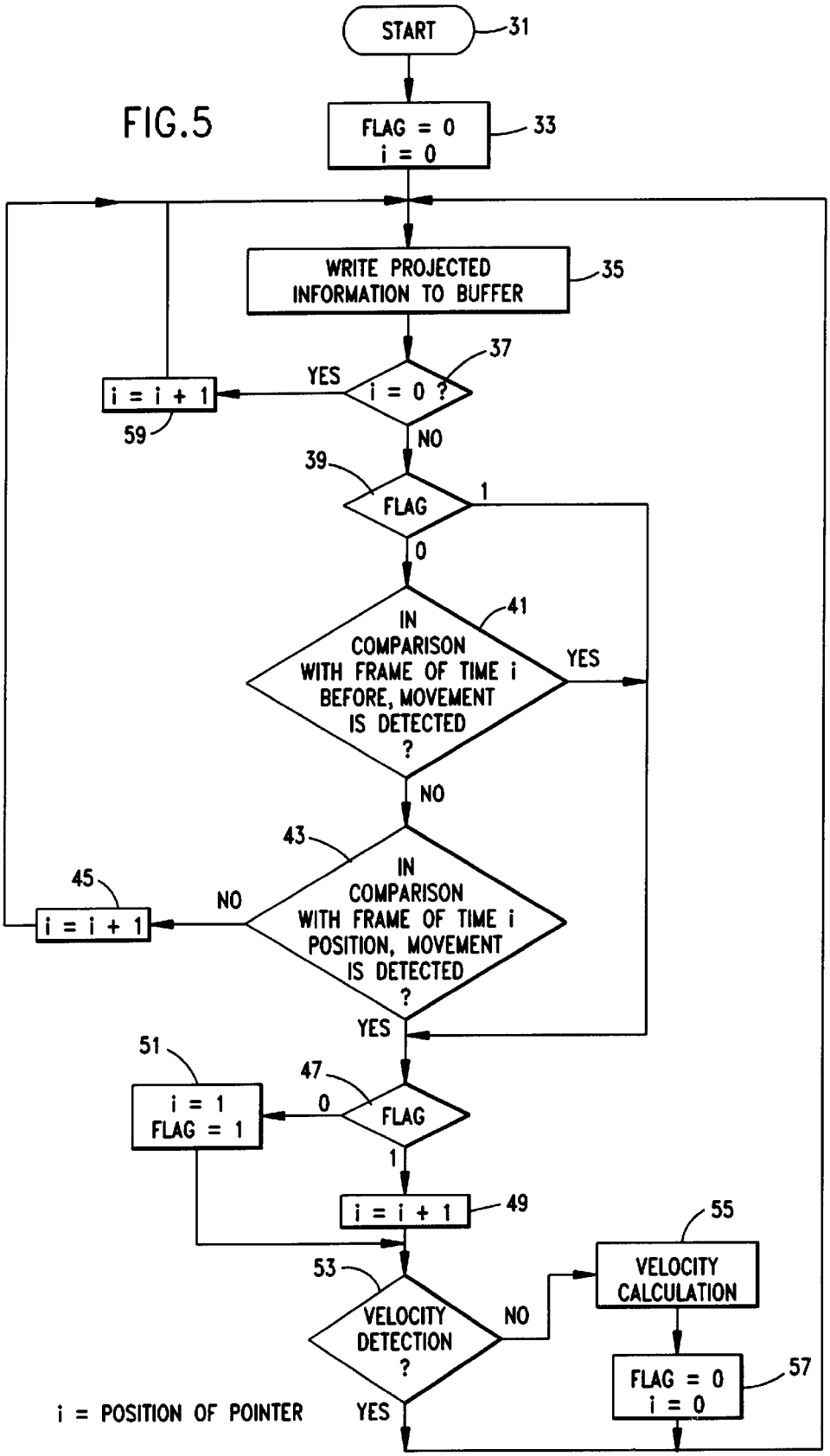
FIG. 5 is a flowchart showing the essential steps of the present invention.

The operation of the movement detecting section 15 will be described in detail with FIG. 5. If this movement detecting section 15 starts its operation, then it will reset its flag representative of whether the movement of a vehicle was detected, and set the pointer of the buffer 17 to zero (step 33). Then, the input one-dimensional projected information is written to the buffer 17 (step 35). At first the pointer indicates zero, but in the case of zero, the pointer waits for another one-dimensional projected information to be input (step 37). When another one-dimensional projected information is input (in step 59 the pointer indicates 1), the check of the flag is performed herein (step 39). Since at the first processing the flag has been reset in step 33, step 37 advances to step 41. In step 41 the one-dimensional projected information which was now input and the one-dimensional projected information which was input time T before are compared. In this comparison, a differential value between two pieces of one-dimensional projected information is taken, and the sum of differential values in local areas, for example, areas of ±n pixels from the peak position of the differential value, is obtained. If the sum of the differential values is greater than a predetermined value, then it will be determined that there is a movement component, and step 41 will advance to step 47.

If, on the other hand, the sum of the differential values is less than the predetermined value, then the comparison between the one-dimensional projected information stored in the pointer position and the one-dimensional projected information of time T before will be performed again (step 43). In the first processing, this comparison makes no sense because the information of the pointer position and the information of time T before are the same. However, this comparison is effective in a case where processing is performed several times and where a vehicle is slowly moving but is not determined to have moved for the time T. In other words, when the movement component is not detected after processing is performed several times, in step 45 the position of the pointer is increased in sequence, and in step 43 a comparison with the information of a certain time before, indicated by the pointer, is made. Therefore, if previous information such as this is compared, it will be conceivable that the movement of a vehicle will be detected. In other words, a sampling time T can be made variable. Therefore, if the movement is detected, step 43 will advance to step 47. If the movement is not detected, the pointer position will be increased as described above (step 45). Note that it is preferable that the movement detecting section 15 hold the latest one-dimensional projected information on only a road on which no vehicle moves. This is because it is necessary to catch the head of a vehicle reliably to reduce a velocity detection error and because the rear end of a vehicle, depending upon the position of the camera 1, does not appear clearly in an image, if photographed as shown in FIG. 1. Therefore, the position of one-dimensional projected information, where the head of a vehicle appears for the first time, is stored, and in a case where the vehicle head has moved out of the photographing area, as shown in FIG. 3D, the movement is recognized by a normal differential method but it is necessary to assume that there is no movement. However, when behind one vehicle there is the head of another vehicle, a detection of movement is made with the above-described latest one-dimensional projected information on only a road on which no vehicle moves.

When the movement of a vehicle is detected, the state of the flag is checked again (step 47). If the flag is standing and the movement has already been detected, the position of the pointer will be shifted (step 49). If the flag is not standing, it will be made to stand and the pointer will be placed in the position of 1. Then, if the velocity of a vehicle is detected, step 53 will advance to step 55, and if the velocity is not detected, step 53 will return to step 35. A description of when and how the vehicle detection is performed will be made later.

As described above, when the movement of a vehicle is detected once, the flag is set, so it is not checked if there is the movement component until a detection of velocity is made (step 39). If done like this, the above-described method will not able to cope with a case where the velocity of a vehicle changes in the photographing area, for example, the velocity is increased, decreased, or stopped. However, since the photographing area is not long as described above, the velocity change in that area is considered to be within a range of error. A method coping with this will be described later.

The velocity detection in step 53 and steps thereafter will be described. In step 53 there is the necessity of finding out the timing of the velocity detection. This timing is different, depending upon the vehicle that is moving. More specifically, for a vehicle moving at relatively slow speed, all of the pieces of one-dimensional projected information of the k storage positions of the buffer 17 store the head of a vehicle. On the other hand, for a vehicle moving at relatively high speed, only few images of the storage positions of the buffer 17 store the head of a vehicle. As described above, in order for the velocity of a vehicle not to be calculated at the rear end of the vehicle, it is important whether or not the head of the vehicle exists. Therefore, it is first detected whether the head has passed the photographing area. This is done with the above-described latest one-dimensional projected information on only a road on which no vehicle moves, which has been stored in advance. Then, with the position of the above-described one-dimensional projected information where the vehicle head moved into the photographing area for the first time (or the flag was set), it is decided whether that position has reached the (k−1)th storage position of the buffer 17. In a case such as this, since the velocity can be calculated with k pieces of information, more accurate detection can be performed.

When any of such conditions is met, a calculation of velocity is made. In this case, the velocity of a vehicle moving at slow speed and the velocity of a vehicle moving at fast speed are calculated separately.

(1) Case of the velocity of a vehicle being slow

This slow case is referred to a case where, within a predetermined time after the head of a vehicle moves into the photographing area, the vehicle head does not move out of the photographing area. For example, in a case where the photographing area is 5 m and a photograph of a vehicle is being taken at 0.05-second intervals (=T), a vehicle moving at a speed of more than 200 km/h moves out within four images photographed. Therefore, if speed more than 200 km/h is handled as high speed, a case where the head of the vehicle is stored over four or more storage positions of the buffer 17 will be handled as the slow case.

Figure 6:
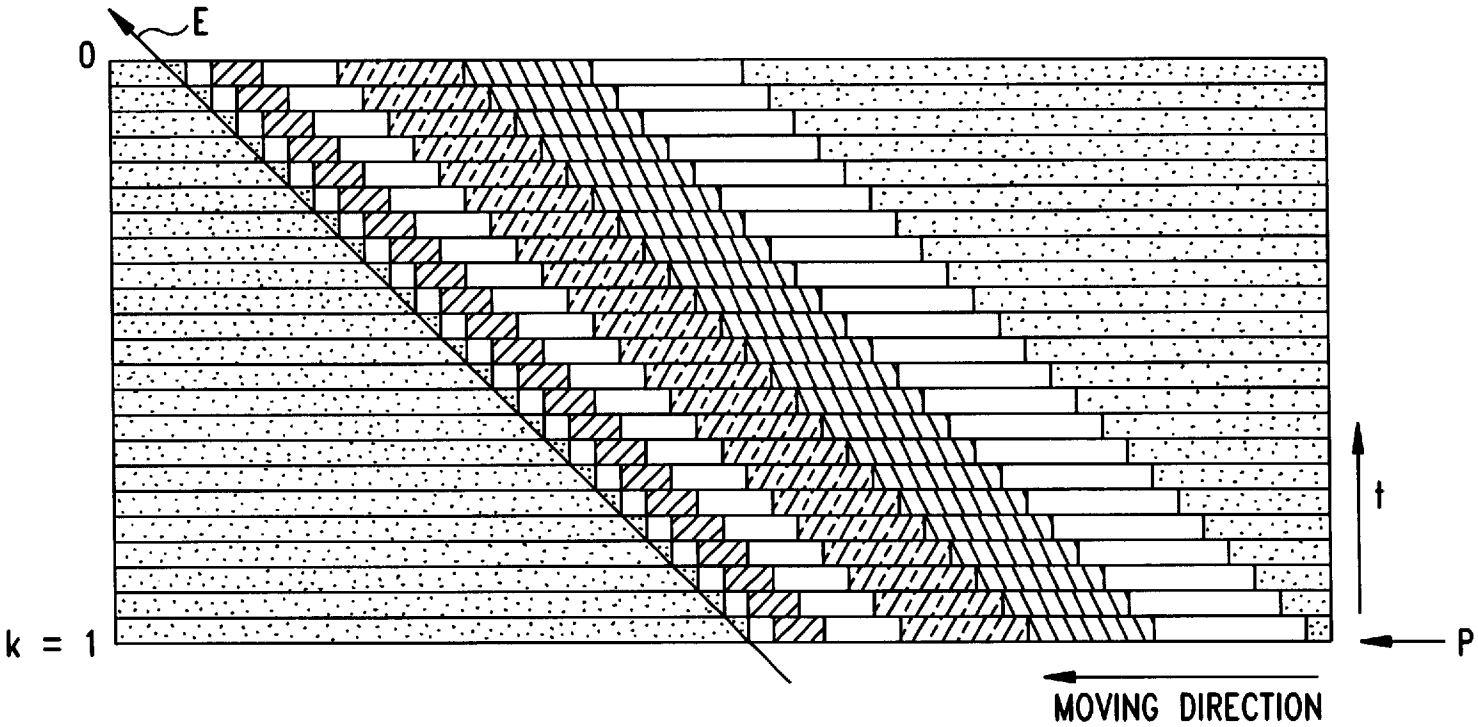
FIG. 6 is a diagram used to explain image processing for performing a detection of velocity.

In this case, until the head of the vehicle moves out of the photographing area from the above-described one-dimensional projected information where the head of the vehicle moved into the photographing area for the first time (what was stored in the position indicated by the pointer, but in a very slow case, what was stored just after a velocity is detected), or when the above-described one-dimensional projected information, where the head of the vehicle moved into the photographing area for the first time, has reached the (k−1)th storage position of the buffer 17, all of k pieces of information are handled as one two-dimensional image. This two-dimensional image is shown in FIG. 6. FIG. 6 shows a case where since the velocity of a vehicle is very slow, the head of the vehicle did not move out of the photographing area even if a photograph of the vehicle was taken k times and where the velocity has been detected one or more times. And, there is shown the state where the flag stands again and then the pointer has again reached the (k−1)th storage position of the buffer 17. Thus, one-dimensional images are connected to generate a two-dimensional image, and the image generated is space differentiated. And, the straight edge is detected, and the inclination of the straight line becomes the velocity of a vehicle. For example, in FIG. 6, the inclination of a straight line such as E represents the velocity of a vehicle.

(2) Case of the velocity of a vehicle being fast

For example, in the case of the above-described example, the head of the vehicle moves out within four images photographed. In general, when the number of the storage positions indicated by the pointer is within a predetermined value, the head of the vehicle will disappear. In such a case, since, in the above-described method using the edge of a straight line, the sampling time becomes short and therefore an error becomes larger, a template of correlation calculation is detected from the one-dimensional projected information stored in the storage position that the pointer indicates, and a velocity is calculated from a position in a photographed image of an object of comparison, where a correlation with that template is maximum. This template is differentiated along the longitudinal axis of one-dimensional information and is ±n pixels from a position where the differentiated value becomes a peak at an area including a movement component which is a difference between the head of a vehicle stored in the storage position indicated by the pointer and the head of a vehicle stored in the one-dimensional projected information of an object of comparison. Also, a search with the one-dimensional projected information of an object of comparison is made between the head of a vehicle of a photographed image (which becomes a template) and two times a previous movement component so as not to catch a mistaken pixel. And, a velocity is calculated from an amount of movement of the template.

After the above-described velocity calculation, the flag is reset and the pointer is set to zero. And, next information projected and processed is fetched and processing is continued.

As described above, if the flag is set once, the algorithm of the present invention would not be able to respond even if there were a change in the velocity of a vehicle. This will not be a problem if great accuracy is not needed, but in a case where the movement component between photographed images is detected, for example, in step 49 and a change rate in that component exceeds a predetermined threshold value, it is conceivable to enter the route where there is a detection of velocity in step 53.

Numerous variations, modifications, and embodiments of the present invention are conceivable. For example, the position of the camera 1 in FIG. 1 has been above a road. This is effective in a road having a plurality of lanes, but in the case of one lane, the camera may be provided not above a road but on the side of a road. Also, the timing of the velocity detection is not limited to the above-described method. For example, in a case where a flag is set at intervals of a time shorter than k·T, the timing of the velocity detection may be set periodically.

As has been described hereinbefore, the present invention is capable of providing an apparatus and method for simply detecting a moving velocity of an object.

Also, the speed of processing can be improved by reducing the number of pixels, which are generated as pixels for velocity detection processing during a sampling time T, without processing as two-dimensional information an image from photographing means.

Further, the influence of background states is reduced and an accurate velocity can be detected.

Further, by providing an apparatus and method for achieving the above-described objects, the timing of signal lights is made short when a vehicle is moving at high speed and made long when a vehicle is moving at slow speed. Accordingly, the signal timing for regulating an amount of traffic and a velocity can be adjusted appropriately.

I claim:

1. An apparatus for detecting a velocity of a moving object, comprising:

photographing means for photographing a predetermined area in which said object moves, at intervals of time T;

projecting means for projecting brightness information of each pixel in an image photographed at said intervals of time T by said photographing means, onto an axis along a moving direction of said object, and for accumulating each brightness value on said axis to generate one-dimensional projected information;

storage means for storing said one-dimensional projected information from said projecting means; and detecting means for detecting said velocity of said object moving in said predetermined area by using a plurality of pieces of said one-dimensional projected information stored in said storage means.

2. The apparatus as set forth in claim 1, wherein said detecting means includes means for spatially differentiating said plurality of pieces of said one-dimensional information which are continuous as one image.

3. The apparatus as set forth in claim 1 or 2, further comprising movement detecting means for detecting that an object moving in said predetermined area exists, and wherein said detecting means is operated when a movement of said object is detected by said movement detecting means.

4. A method for detecting a velocity of a moving object, comprising the steps of:

photographing a predetermined area in which said object moves, at intervals of time T;

projecting brightness information of each pixel in an image photographed at said intervals of time T, onto an axis along a moving direction of said object, and accumulating each brightness value on said axis to generate one-dimensional projected information;

storing one-dimensional projected information; and detecting said velocity of said object moving in said predetermined area by using a plurality of pieces of said one-dimensional projected information stored.

5. The method as set forth in claim 4, wherein the detecting step includes the step of spatially differentiating said plurality of pieces of said one-dimensional information which are continuous as one image.

6. The method as set forth in claim 4 or 5, further comprising the movement detecting step of detecting that an object moving in said predetermined area exists, and wherein the detecting step is executed when a movement of said object is detected by said movement detecting step.

* * * * *